US006591985B2

(12) United States Patent
Lai

(10) Patent No.: US 6,591,985 B2
(45) Date of Patent: Jul. 15, 2003

(54) STRUCTURE OF TOOLBOX

(76) Inventor: Ching-Hai Lai, No. 16, Lane 63, Chang South Road, Sec. 3, Changhua (TW)

( * ) Notice: Subject to any disclaimer, the term of this patent is extended or adjusted under 35 U.S.C. 154(b) by 11 days.

(21) Appl. No.: 09/903,646

(22) Filed: Jul. 13, 2001

(65) Prior Publication Data

US 2003/0010660 A1 Jan. 16, 2003

(51) Int. Cl.[7] ..... B65D 85/28
(52) U.S. Cl. ..... 206/373; 206/751; 206/756
(58) Field of Search ..... 206/373, 759, 206/762, 45.23, 736, 751, 756, 45.2, 216, 223, 372; 220/833, 835, 324, 326

(56) References Cited

U.S. PATENT DOCUMENTS 4,930,628 A * 6/1990 Bridges ..... 206/373
5,267,668 A * 12/1993 Jones ..... 206/363
5,915,554 A * 6/1999 Hung ..... 206/373
6,021,901 A * 2/2000 Wolfe ..... 206/1.5
6,131,740 A * 10/2000 Huang ..... 206/759

* cited by examiner

*Primary Examiner*—Mickey Yu
*Assistant Examiner*—John G. Pickett
(74) *Attorney, Agent, or Firm*—Rabin & Berdo, P.C.

(57) ABSTRACT

An improved structure of toolbox aims at the shortcomings of the traditional toolbox structure that can only be placed horizontally but not vertically. By means of the bottom of bottom box structure having a blocking slope with an appropriate angle and a central extended coupling structure, the present invention works together with the bottom of a covering tray structure being disposed at a coupling opening and a blocking surface. Since the blocking slope presses against the blocking surface and gives an inclined angle for the arrangement of placing the toolbox vertically, the user is able to find and store tools in a quick manner.

4 Claims, 4 Drawing Sheets

STRUCTURE OF TOOLBOX

BACKGROUND OF THE INVENTION

1. Field of the Invention

The present invention relates to an improved structure of a toolbox, more particularly to an improved structure of a toolbox that can be placed both horizontally and vertically.

2. Description of the Prior Art

In general, the prior-art toolbox structure has a shortcoming that can be only placed horizontally but not vertically, so that it is inconvenient for the users to use such toolbox.

In view of the shortcomings of the prior art mentioned above, which are the subjects of improvements for a long time, hence the inventor of the present invention based on years of experience accumulated from the engagement in the related industry conducted extensive research to resolve the foregoing shortcomings and invented the present invention to provide an improved toolbox structure.

Therefore, the primary objective of the present invention is to improve the shortcoming of the prior-art toolbox structure that can only be placed horizontally but not vertically. By means of the bottom of bottom box structure having a blocking slope with an appropriate angle and a central extended coupling structure, the present invention works together with the bottom of a covering tray structure being disposed at a coupling opening and a blocking surface. Since the blocking slope presses against the blocking surface and gives an inclined angle for the arrangement of placing the toolbox vertically, the user is able to find and access tools in a quick manner.

To make it easier for our examiner to understand the objective of the invention, structure, innovative features, and performance, we use a preferred embodiment together with the attached drawings for the detailed description of the invention.

BRIEF DESCRIPTION OF THE DRAWINGS

Other objects, features, and advantages of the invention will become apparent from the following detailed description of the preferred but non-limiting embodiment. The description is made with reference to the accompanying drawings, in which.

DESCRIPTION OF THE PREFERRED EMBODIMENT

Figure 1:
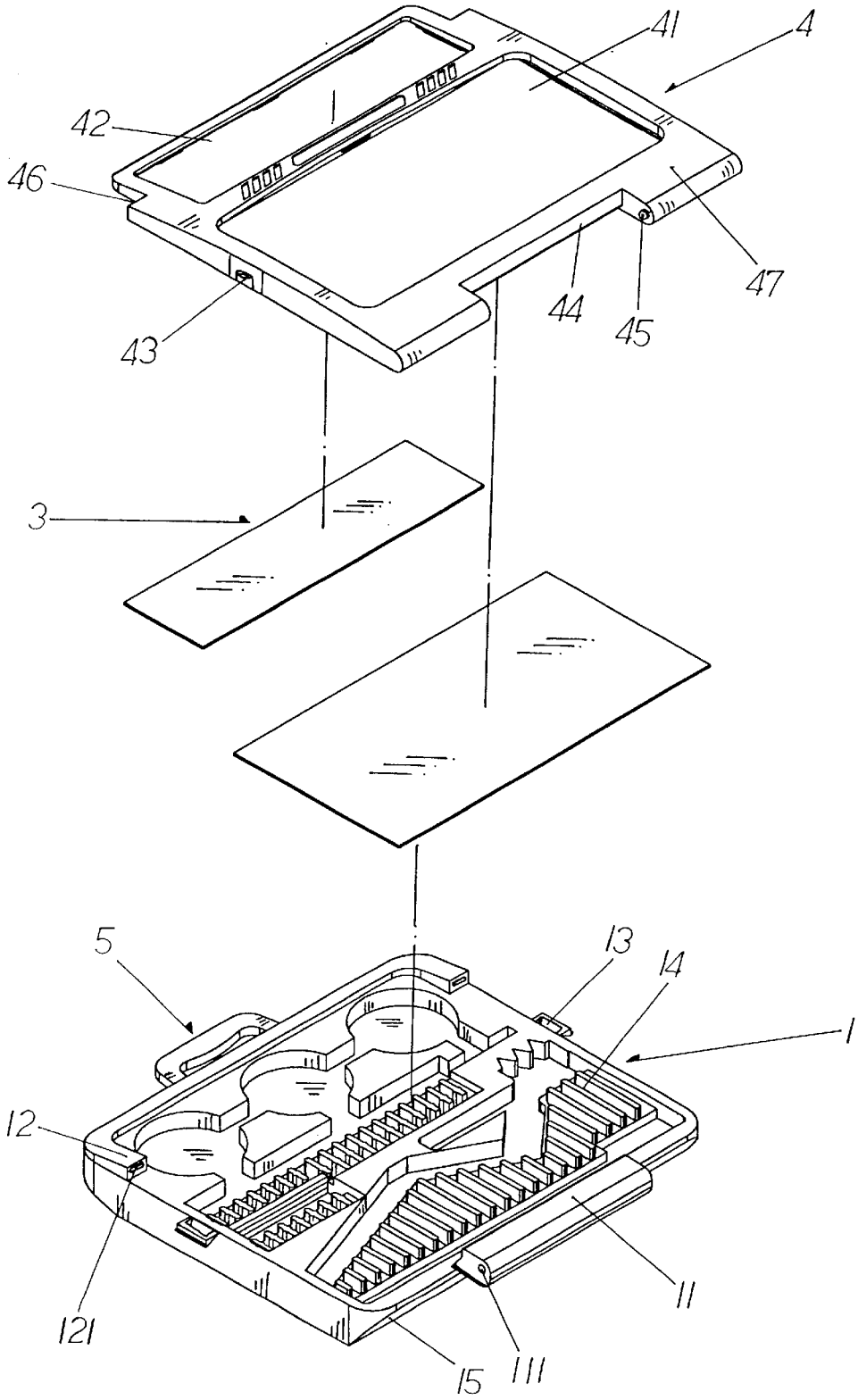
FIG. 1 shows the disassembled structure of the present invention.
Figure 4:
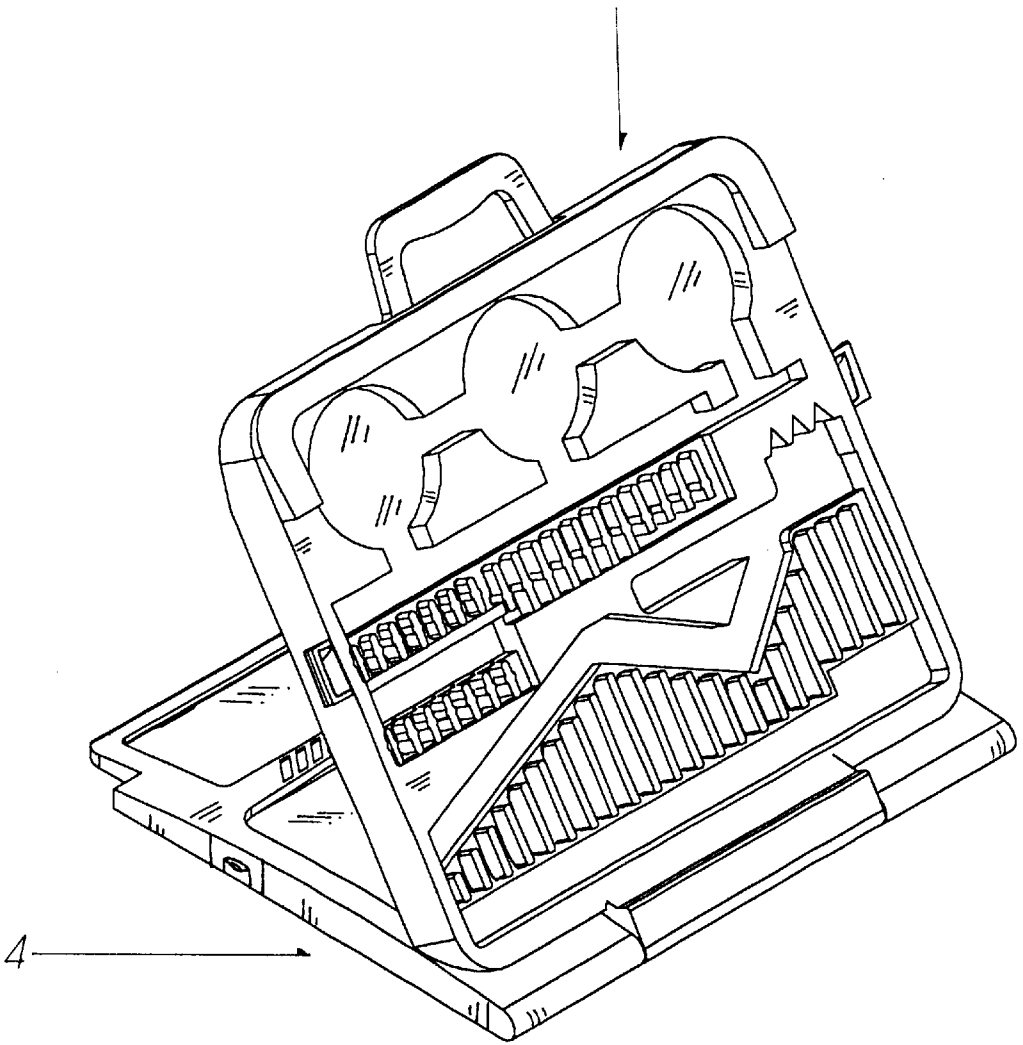
FIG. 4 shows the toolbox structure according to a preferred embodiment of the present invention when the tools are accessed.

Please refer to FIG. 1 for the disassembled structure of the toolbox according to the present invention. The toolbox includes a bottom box structure 1 and a covering tray structure 4. The front surface of the bottom box structure 1 has a plurality of fixing grooves 14 for holding different tools, a handle 5 is disposed in the middle of the top side, and a protruded member 12 is formed on both two lateral ends on the top of the front surface of the bottom box structure 1. The protruded member 12 can also have a latch flange 121 for latching into a latch hole 46 of the covering tray structure 4. The latch hole 46 is disposed on each lateral side in the front of the top of the covering stray structure 4. A latch buckle 13 is disposed at an appropriate distance on the lateral sides of bottom box structure 1 and a respective latch flange 43 is formed on each lateral side of the covering tray structure 4. A coupling member 11 is extended from the middle of the blocking slope 15 and a coupling hole 111 is disposed on each of the lateral side thereof. Further, a large opening 41 and a small opening 42 are formed in the covering tray structure 4. The covering tray structure 4 is adapted to cover the front surface of the bottom box structure 1 and has the openings 41, 42 that allow the grooves 14 to be exposed when the cover is closed. A coupling protrusion 45 is formed on a coupling recess 44 at the bottom side of the covering tray structure 4. Each of two opposing lateral sides of the covering tray structure 4 has an exposed inner edge, and each extends from the top side of the covering tray structure 4 to the bottom side of the covering tray structure 4. By such arrangement, the covering tray structure 4 is pivotally coupled to the coupling member 11 of the bottom box structure 1 by the coupling recess 44. At a close status, the covering tray structure 4 is positioned over the front surface of the box with the respective inner edges of the lateral side of the covering tray structure 4 abutting against the front surface of the bottom box structure 1 in a region of the lateral sides of the box, and with the top side of the covering tray structure 4 being adjacent to the top side of the bottom box structure 1. As such, the latch buckle 13 of the bottom box structure 1 can be tightly latched to the latch flange 43 of the covering tray structure 4 to prevent the tools from missing and losing. When at an open status, the covering tray structure 4 is pivoted to a position in which the respective inner edges of the lateral sides of the covering tray structure 4, from the top side of the covering tray structure 4 to the bottom side of the covering tray structure 4, abut against a supporting surface (such as a table top), and the blocking slope 15 of the bottom box structure 1 abuts against an outer surface of the covering tray structure 4, to thereby support and retain the bottom box structure at an angle relative to the cover, as shown in FIG. 4. As such, the bottom box structure 1 of the toolbox is vertically placed so that the user can access tools in a quick manner.

Figure 2:
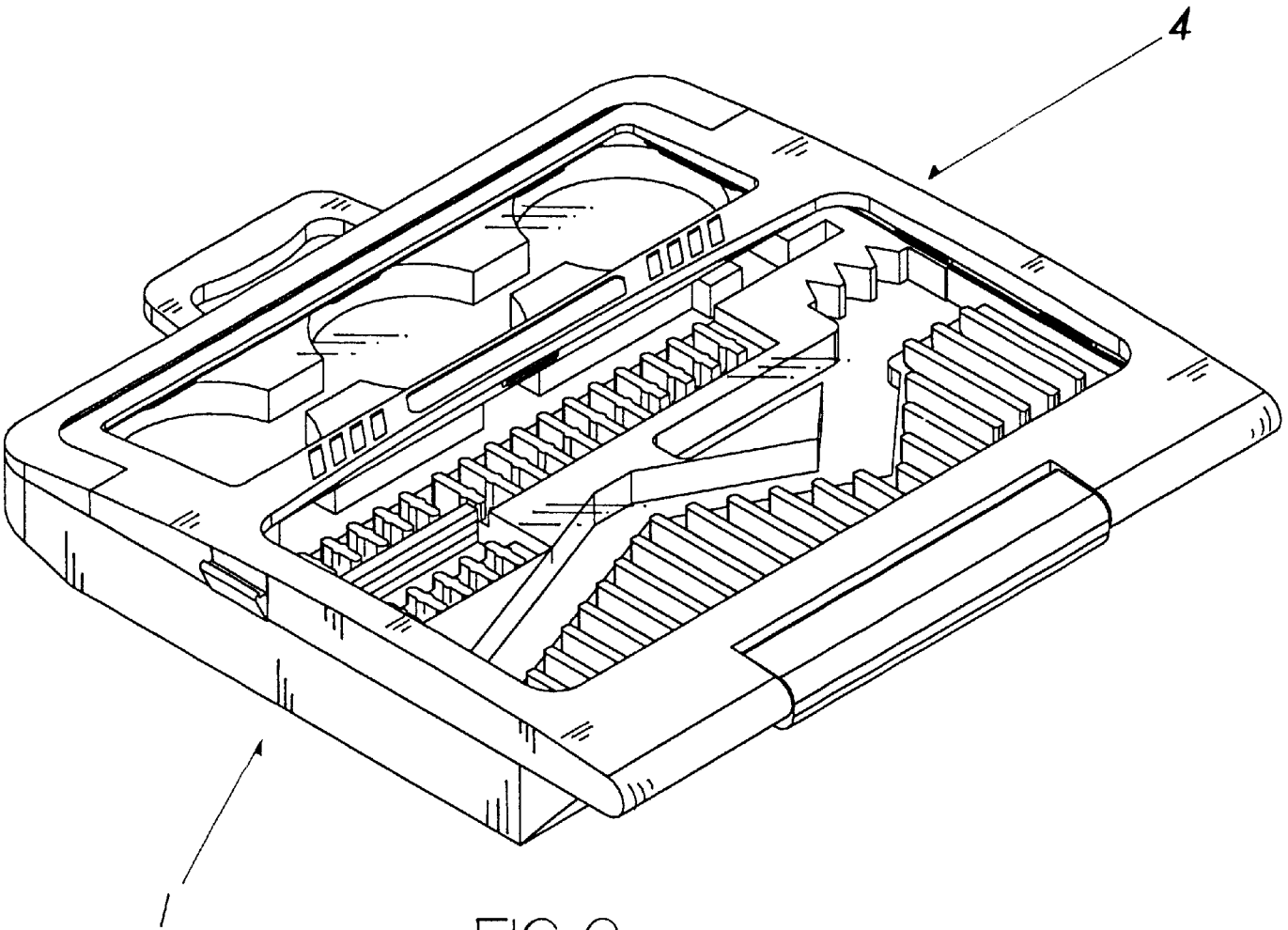
FIG. 2 shows an embodiment of the toolbox structure according to the present invention when it is closed.

Further, please refer to FIG. 2 for the structure according to the preferred embodiment of the present invention when the toolbox is at the close status. After the covering tray structure 4 and the bottom box structure 1 are assembled, the user can fully examine the items and quantity of different tools in the toolbox without opening the covering tray structure 4 to determine if there is a need to add or replace the tools.

Figure 3:
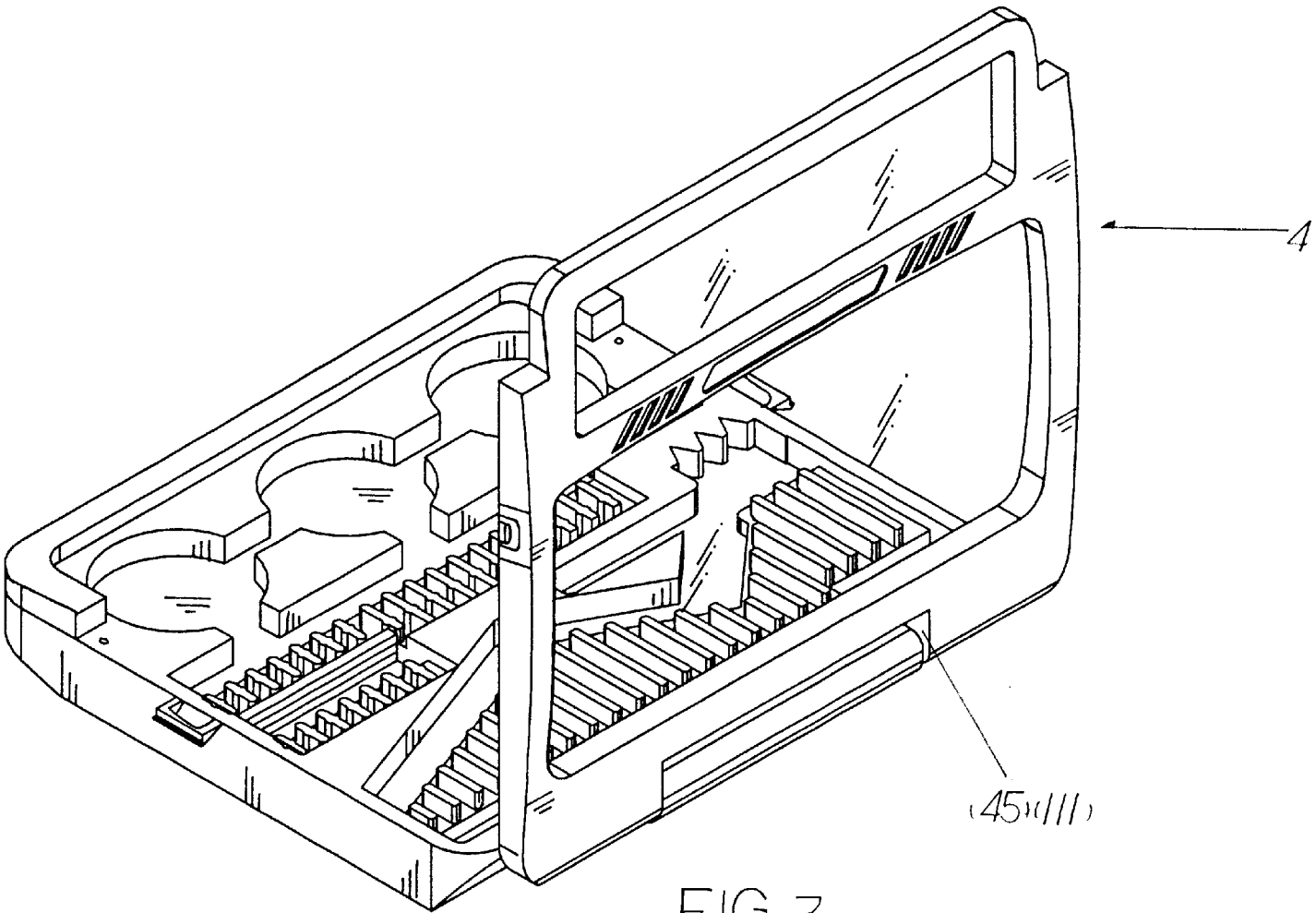
FIG. 3 shows an embodiment of the toolbox structure according to the present invention when it is opened.

Further, please refer to FIG. 3 for the structure according to the preferred embodiment of the present invention when the toolbox is at the open status. Due to the original design that provides a convenient way to open or cover the covering member 4 for the toolbox structure and due to the cost consideration that provides a portable structure made of light material such as plastics, the present invention incorporates a coupling protrusion 45 to securely engage to the coupling holes 111.

Finally, please refer to FIG. 4 for the toolbox structure according to the preferred embodiment of the present invention for the access of the tools, which overcomes the shortcomings as depicted in FIG. 3 as a conventional toolbox at the open status. The covering tray structure 4 of the present invention is designed to have dual functions. Besides the general opening and closing functions as a cover, it also has the function to support the bottom box structure 1 being vertically placed such that the user can access the desired tools in a quick manner.

In summation of the above description, the present invention provides an improved structure that gives an arrangement of placing the toolbox vertically, and enables the user to access the tools more conveniently. This improved structure has been proved practical during actual trial. The inventor of the present invention based on years of experience in the related industry conducted extensive research to enhance the structure of the toolbox and believes the present invention meets the patent ability requirements, which is hereby submitted for patent application.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A toolbox, comprising:

a box, including a top side with a handle furnished in a center thereof, a bottom side with a coupling member furnished in a center thereof, two opposing lateral sides, each extending from the top side to the bottom side, and each having a buckle furnished thereon, a rear surface having a slope formed in a region of the bottom side that tapers toward the coupling member, and that extends continuously from one of the lateral sides to another one of the lateral sides, and a front surface that opposes the rear surface, and having a plurality of grooves formed therein for holding tools; and a cover adapted to cover the front surface of the box, and having an opening that allows the grooves to be exposed when the cover is closed, the cover further including a top side, a bottom side that has a recess formed in a center thereof, the recess receiving the coupling member for pivotally connecting the cover to the box, the recess being separated from the opening so that the recess and opening are not contiguous and two opposing lateral sides, each having an exposed inner edge, and each extending from the top side of the cover to the bottom side of the cover, and each having a flange formed thereon for latching with a respective buckle when the cover is closed, whereby, when the cover is closed, the cover is positioned over the front surface of the box with the respective inner edges of the lateral sides of the cover abutting against the front surface of the box in a region of the lateral sides of the box, and with the top side of the cover being adjacent to the top side of the box, and when the cover is opened, the cover is pivoted to a position in which the respective inner edges of the lateral sides of the cover, from the top side of the cover to the bottom side of the cover, abut against a supporting surface, and the entire slope of the box abuts against an outer surface of the cover, to thereby support and retain the box at an angle relative to the cover.

2. A toolbox as claimed in claim 1, further comprising a transparent plate disposed in the opening.

3. A toolbox as claimed in claim 1, wherein the box further includes two protruded members respectively formed on two lateral ends of the front surface, the cover having two respective holes formed therein to engage with the protruded members when the cover is closed.

4. A toolbox as claimed in claim 1, wherein the coupling member has two coupling holes respectively formed on two lateral ends thereof, and the cover has two respective protrusions formed on two lateral walls that define the recess, each coupling hole being engagable with a respective protrusion so that the cover is pivotally connected to the box.

* * * * *